US009251675B2

(12) United States Patent
Carrington

(10) Patent No.: US 9,251,675 B2
(45) Date of Patent: Feb. 2, 2016

(54) MULTIPLE LED OMNI-DIRECTIONAL VISUAL ALARM DEVICE

(71) Applicant: Honeywell International Inc., Morristown, NJ (US)

(72) Inventor: Paul Terrence Carrington, Redditch (GB)

(73) Assignee: Honeywell International Inc., Morris Plains, NJ (US)

( * ) Notice: Subject to any disclaimer, the term of this patent is extended or adjusted under 35 U.S.C. 154(b) by 52 days.

(21) Appl. No.: 14/061,232

(22) Filed: Oct. 23, 2013

(65) Prior Publication Data

US 2015/0109137 A1 Apr. 23, 2015

(51) Int. Cl.

| | |
|---|---|
| ***G08B 5/00*** | (2006.01) |
| ***G08B 5/36*** | (2006.01) |
| ***F21V 5/04*** | (2006.01) |
| ***F21S 8/00*** | (2006.01) |
| *F21Y 101/02* | (2006.01) |
| *F21W 111/00* | (2006.01) |
| *F21Y 103/02* | (2006.01) |

(52) U.S. Cl.

CPC ... *G08B 5/36* (2013.01); *F21S 8/03* (2013.01); *F21V 5/045* (2013.01); *F21W 2111/00* (2013.01); *F21Y 2101/02* (2013.01); *F21Y 2103/022* (2013.01)

(58) Field of Classification Search

CPC ..... G08B 5/36; F21K 9/54
USPC ..... 340/815.4; 362/293, 297, 317, 335, 362/611, 627

See application file for complete search history.

(56) References Cited

U.S. PATENT DOCUMENTS

| | | | | |
|---|---|---|---|---|
| 5,947,587 | A * | 9/1999 | Keuper et al. | 362/235 |
| 6,970,296 | B2 * | 11/2005 | Blumel | 359/641 |
| 7,237,924 | B2 * | 7/2007 | Martineau et al. | 362/231 |
| 8,833,978 | B2 * | 9/2014 | Wu et al. | 362/309 |
| 8,851,713 | B2 * | 10/2014 | Kayanuma et al. | 362/311.06 |
| 2007/0211473 | A1 | 9/2007 | Peck | |
| 2009/0040065 | A1 | 2/2009 | Dalton et al. | |
| 2011/0134636 | A1 | 6/2011 | Chang et al. | |
| 2012/0120667 | A1 * | 5/2012 | Schenkl | 362/335 |
| 2014/0049939 | A1 * | 2/2014 | Kuenzler et al. | 362/84 |

FOREIGN PATENT DOCUMENTS

| | | | |
|---|---|---|---|
| CA | 2 802 468 | A1 | 7/2013 |
| DE | 20 2006 014 814 | U1 | 1/2007 |
| WO | WO 2006/037075 | A2 | 4/2006 |
| WO | WO 2008/110796 | A1 | 9/2008 |
| WO | WO 2012/172510 | A1 | 12/2012 |

OTHER PUBLICATIONS

Extended European search report from corresponding EP application 14187576.5, dated Feb. 25, 2015.

* cited by examiner

*Primary Examiner* — Tai T Nguyen
(74) *Attorney, Agent, or Firm* — Conley Rose, P.C.; Kristin Jordan Harkins

(57) ABSTRACT

A visual alarm indicating output device includes a plurality of light sources arranged in a circular pattern about a centerline. Each of the sources is oriented so that respective light output is directed to a common, cylindrical Fresnel lens. The lens is symmetrical about the centerline. The sources are pulsed from a common current supply.

20 Claims, 7 Drawing Sheets

Device orientation against the EN54-23:2010 standard is not required as light output is achieved from 0.0° through to 180.0° in the plane parallel to the PCB (alpha plane) and from 0.0° through to 360.0° in the rotational orientation plane (beta plane)

MULTIPLE LED OMNI-DIRECTIONAL VISUAL ALARM DEVICE

FIELD

The application pertains to alarm indicating visual output devices. More particularly, the application pertains to such output devices which project non-oriented, omni-directional three hundred sixty degree light output relative to a center line of the device.

BACKGROUND

The main drivers within the Visual Alarm Devices sector of the Fire/Life safety industry revolve around the usual commercial factors of cost, device installation time, power consumption, and overall output performance characteristics. In this regard, there can be added installation costs associated with the installation and adjustment of the field of light emitted from alarm indicating visual output devices.

EN54-23 is a new European Standard supporting the manufacture and use of VAD's (Visual Alarm Devices) for or within an emergency evacuation system. Prior to the new standard, VAD type devices had no minimum or maximum output requirements that needed to be met. The new standard is in general for the European market a game changer for the evacuation industry. Now there are minimum light output requirements vs. the amount of power through a flashed pulse which are to be available from the evacuation system.

The new EN54:23 Standard requires manufacturers to develop visual beacons that are capable of delivering set values of light coverage volumes at controlled intensity parameters. To reduce power consumption the standard allows devices to save wasted light distribution and allows for orientated device installation.

DETAILED DESCRIPTION

Figure 1:
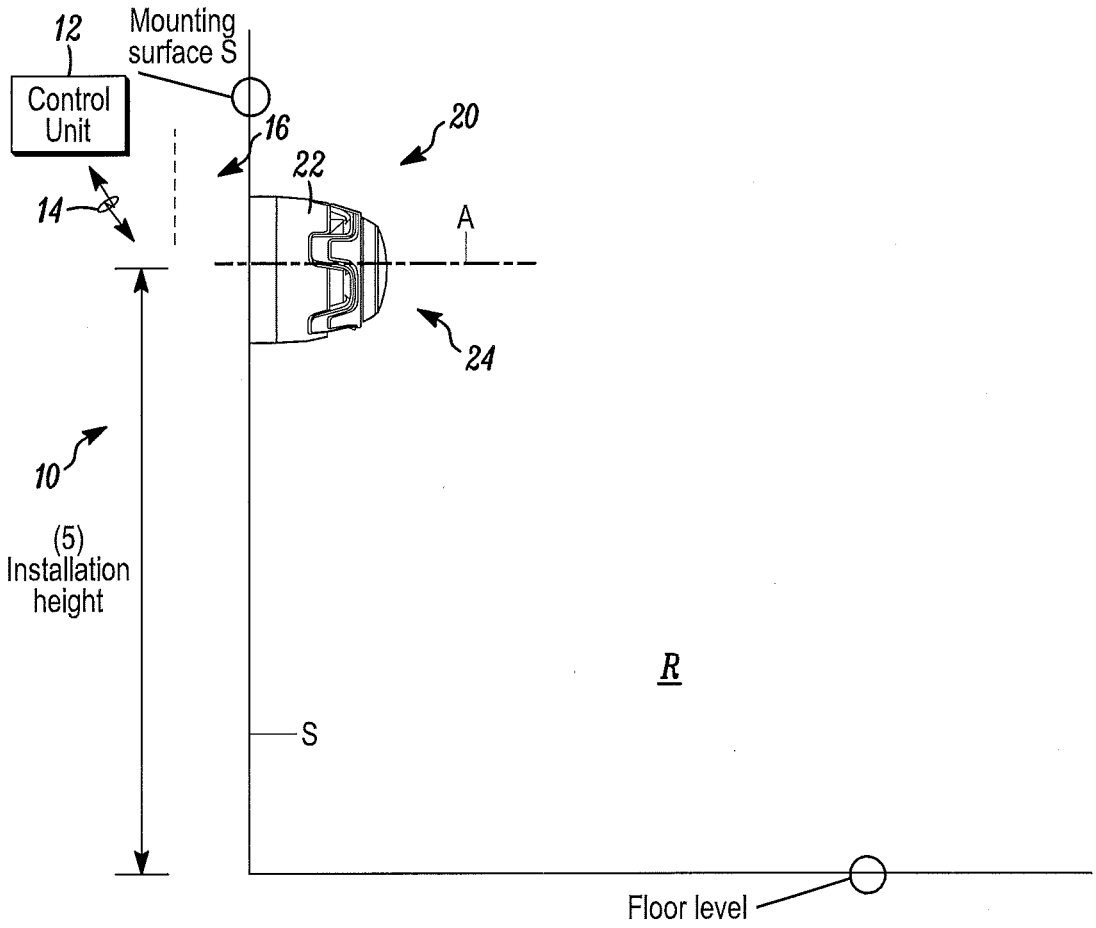
FIG. 1 illustrates aspects of a system, in accordance herewith, with a selected alarm indicating audible/visual output device installed in a region being monitored.
Figure 2:
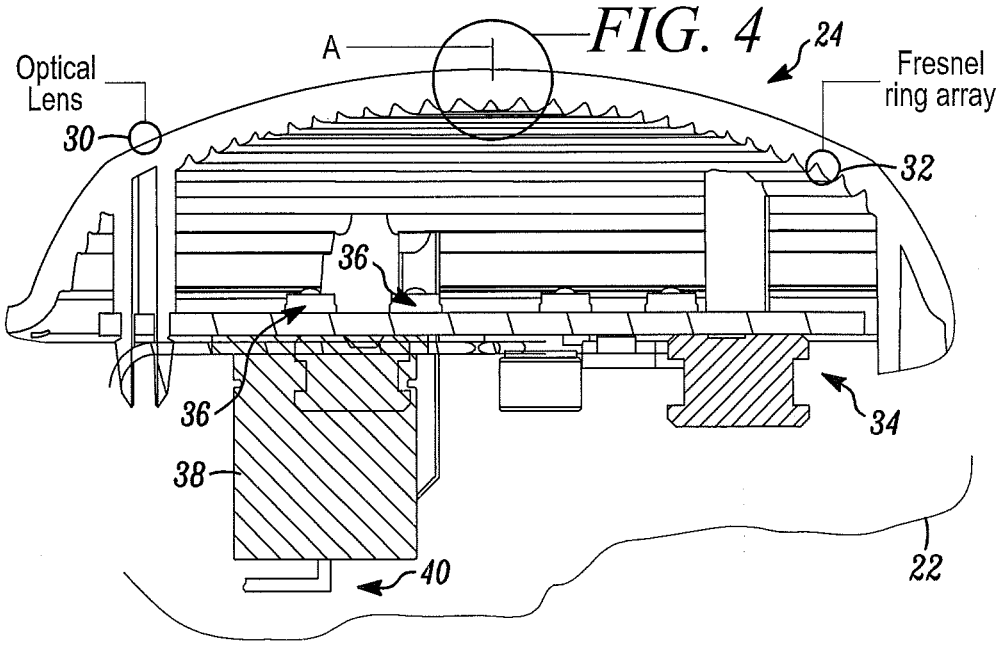
FIG. 2 is a side sectional view of portions of the output device of FIG. 1.
Figure 3:
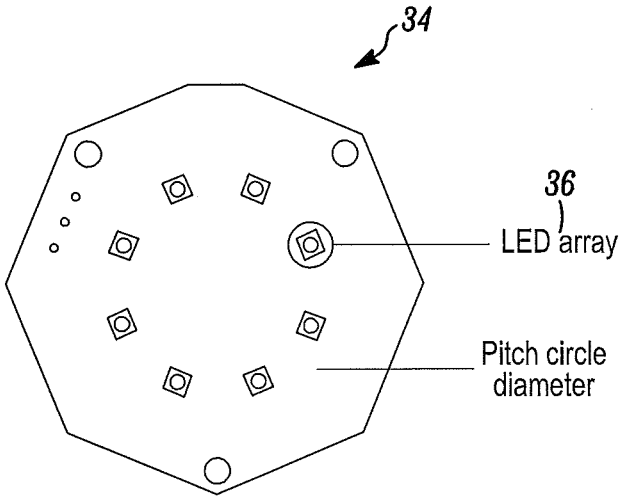
FIG. 3 is a top planar view of a light emitting diode array usable in the output device of FIG. 2.

While disclosed embodiments can take many different forms, specific embodiments hereof are shown in the drawings and will be described herein in detail with the understanding that the present disclosure is to be considered as an exemplification of the principles hereof, as well as the best mode of practicing same, and is not intended to limit the claims hereof to the specific embodiment illustrated.

In embodiments hereof, an advantageous solution is provided to the requirements of the EN54:23 Standard. This solution enables the installer to install the device on the wall, or ceiling, without the need to orientate the device for desired light coverage. A single Fresnel type lens, symmetrical about a centerline can be used to distribute the output light in accordance herewith.

In one aspect hereof, light is distributed through one hundred eighty degrees relative to a plane parallel to a printed circuit board that carries an array of light emitting diodes, the alpha plane. Light is also distributed through three hundred sixty degrees relative to the axis of symmetry (perpendicular to the alpha plane), in the rotational orientation plane, the beta plane. The array of light emitting diodes is positioned between the lens and the printed circuit board and driven with a switch mode power supply.

In another aspect hereof, a degree of power loss is accepted to provide for a non-orientated installation. The installer merely needs to establish an appropriate location for the device and mount it at that location. No time or effort are needed, beyond the mounting and connecting process, to provide the desired omni-directional light output pattern to satisfy the requirements of EN54:23.

FIG. 1 illustrates a system 10 which includes an alarm/monitoring control unit or panel, 12 which is coupled via medium 14 to a plurality of substantially identical visual, or audible/visual output devices 16 which are used to alert individuals in a region R being monitored as to the presence of an alarm indicating condition. Those of skill will understand that the system 10 could be coupled to a plurality of ambient condition detectors scattered throughout the region R. Further, the medium 14 could be a wireless medium or a wired medium implemented, for example, with an electric cable.

Exemplary audible/visual output device 20 could correspond to the members of the plurality 16. As those of skill will understand a discussion of the unit 20 is applicable to other members of the plurality 16 and they do not need to be separately discussed.

Unit 20 can be mounted on a surface S of a wall in the region R at a preferred installation height on the order of 2.4 meters above the floor on the region R. Unit 20 includes a mounting base 22 which can be attached to the surface S. A lens/electronics assembly 24 can be releasibly carried by the base 22. For example assembly 24 can engage the base with a snap-fit arrangement, a friction fit or a twist-lock configuration all without limitation.

The assembly 24 can communicate, via the base 22 and medium 14, with the control unit 12. The medium 14 can provide electrical energy to activate the units 16, 20. Alternately, the unit 16, 20 can receive instructions or commands via the medium 14 and a local supply can be provided to energize the units 16, 20.

Figure 4:
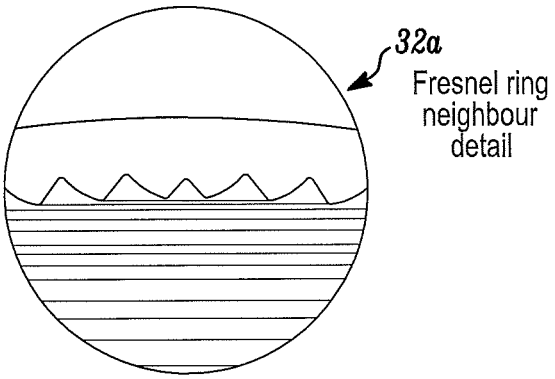
FIG. 4 is a sectional view of a portion of a lens of the output device of FIG. 2.

The exterior surface of the unit 20 is symmetrical with respect to an axis A. The assembly 24 can carry an optical lens 30 implemented as a Fresnel ring array 32. Additional details of the array 32 are illustrated in FIG. 4, detail 32*a*. Lens 30 is symmetrical with respect to axis A.

The lens 30 also carries a printed circuit board 34. The printed circuit board is preferably arranged so as to be on the order of 18.5 mm from the exterior tip of the lens 30.

A light emitting diode array 36 is arranged on printed circuit board 34 in a circular pattern about the axis A. Control and drive current circuits 38 are also carried on assembly 24, coupled to the array 36, and, via wiring 40 to the medium 14 and the control unit 12. The array 36 has a diameter preferably on the order of 30 mm.

The circuits 38 provide drive current to the light emitting diodes which, in response thereto, emit light pulses that are transmitted via lens 30 into the region R in accordance with a predetermined pattern. For example, drive currents of 200 mA can be provided to each string of four diodes. This current can be in the form of square wave pulses, with a maximum amplitude of one amp, and with a duration of 66 mSec.

Figure 5A:
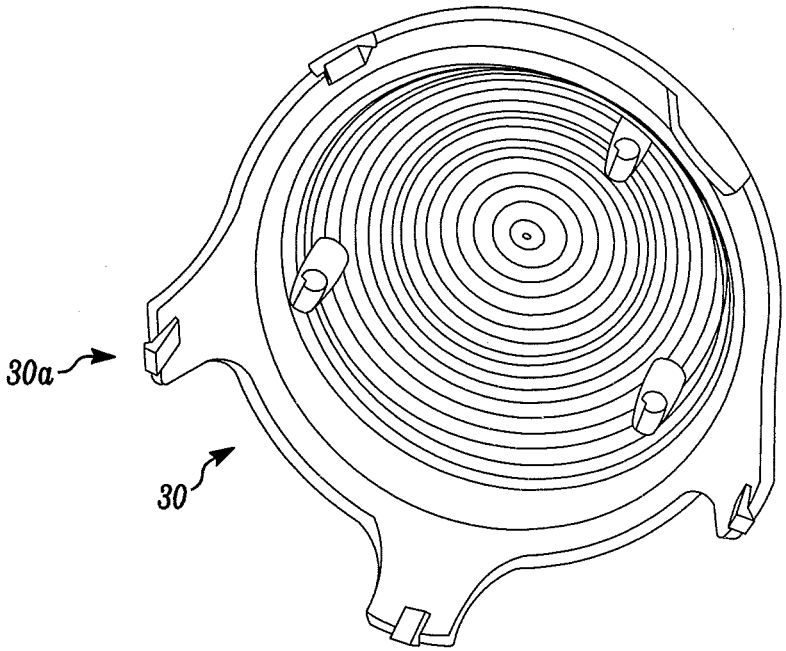
FIG. 5A is a bottom view of the lens of FIG. 2.
Figure 5B:
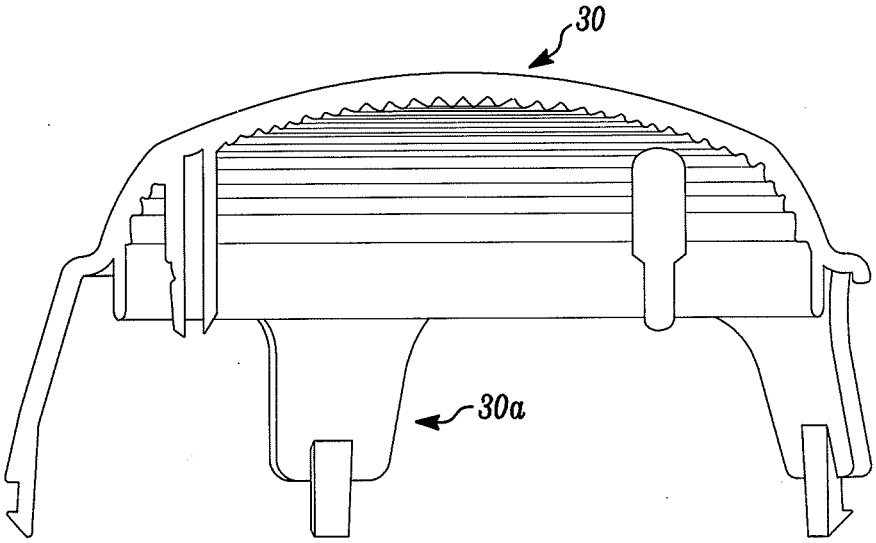
FIG. 5B is a side, sectional view of the lens of FIG. 2.

FIGS. 5A and 5B illustrate bottom and side views of the lens 30. The snap fit features 30*a* can be used to attach the lens 30 to the base 22.

Figure 6A:
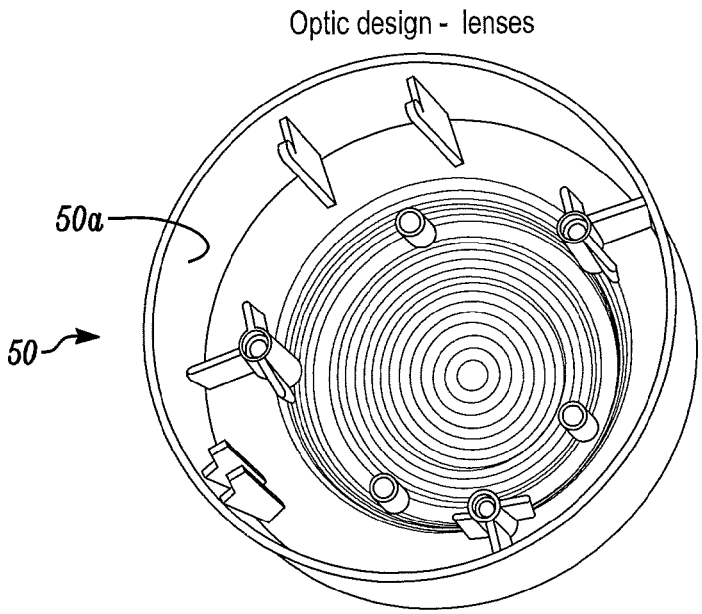
FIG. 6A is a bottom view of an alternate form of the type of lens as in FIG. 2.
Figure 6B:
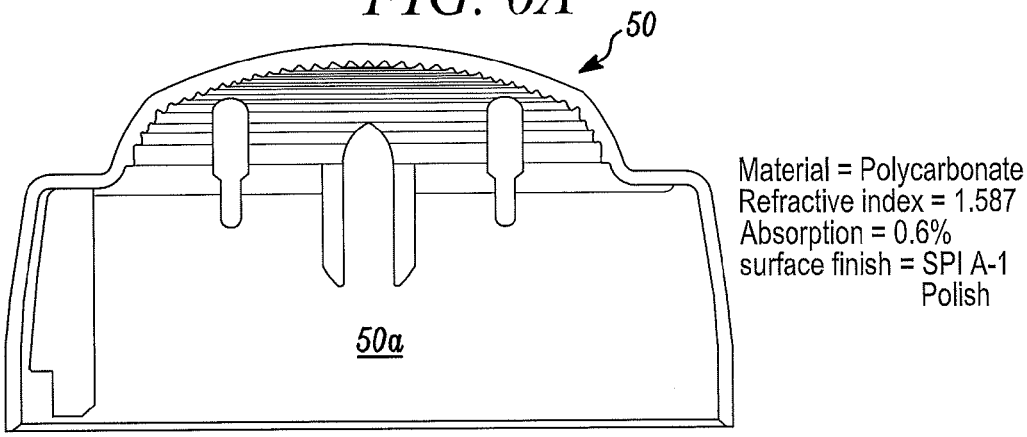
FIG. 6B is a side sectional view of the lens of FIG. 6A.
Figure 6C:
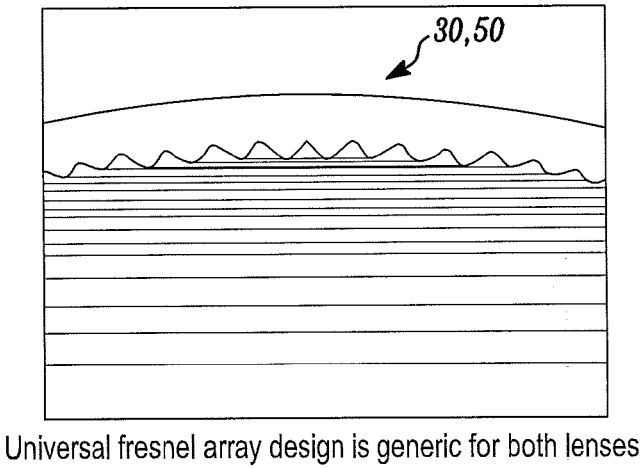
FIG. 6C is an enlarged side sectional view of a portion of the lenses of FIGS. 5A and 6A.

FIGS. 6A, 6B illustrate an alternate lens configuration 50. Lens 50 has a surround 50*a* which can slidably engage an alternate to the base 22 as would be understood by those of skill in the art. As illustrated in FIG. 6C, the lens 30 and the lens 50 are identical in their optical characteristics. Both include the same Fresnel array design.

Figure 7A:
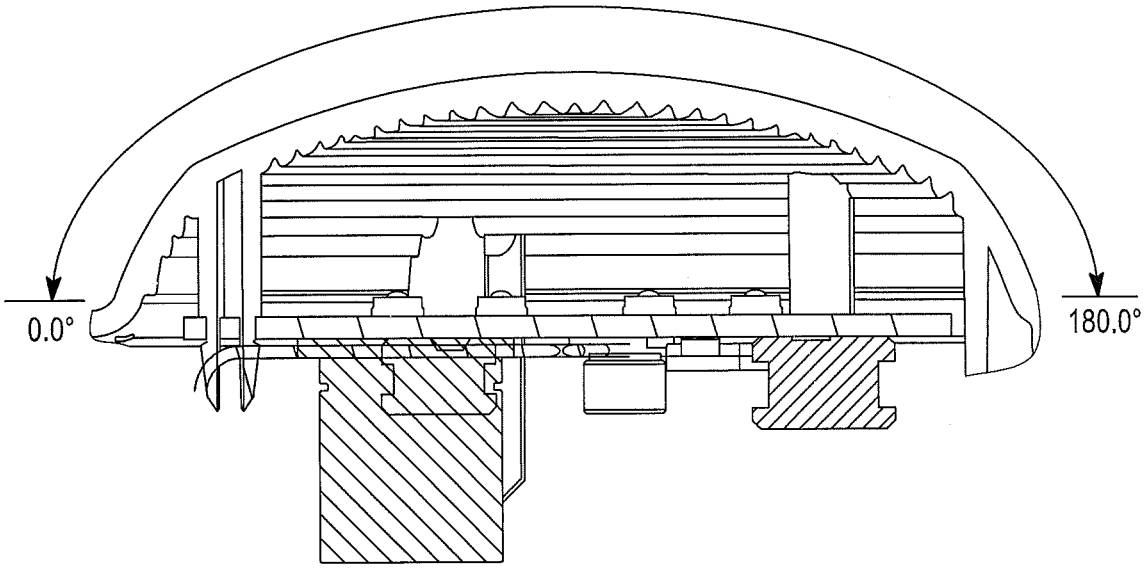
FIG. 7A is a side sectional view of the output device of FIG. 1 illustrating additional details thereof.
Figure 7B:
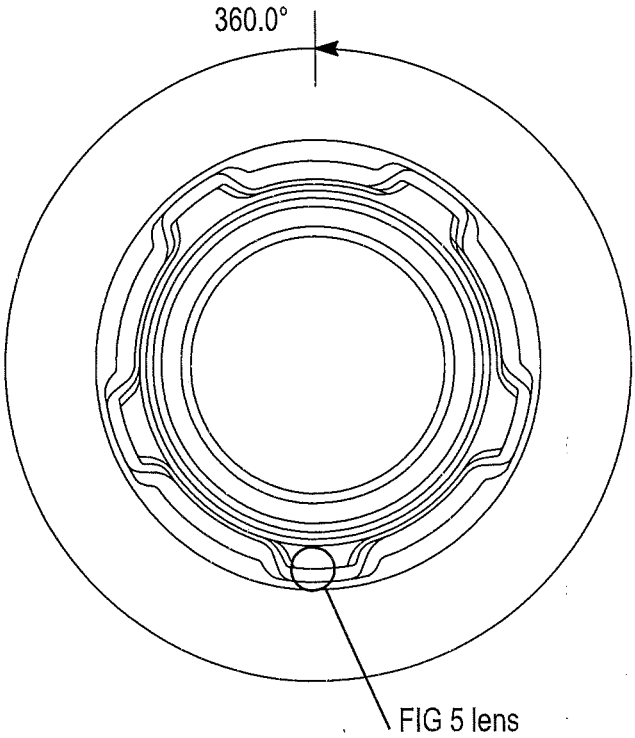
FIG. 7B is a top planar view of the lenses of FIGS. 5A, 5B.
Figure 7C:
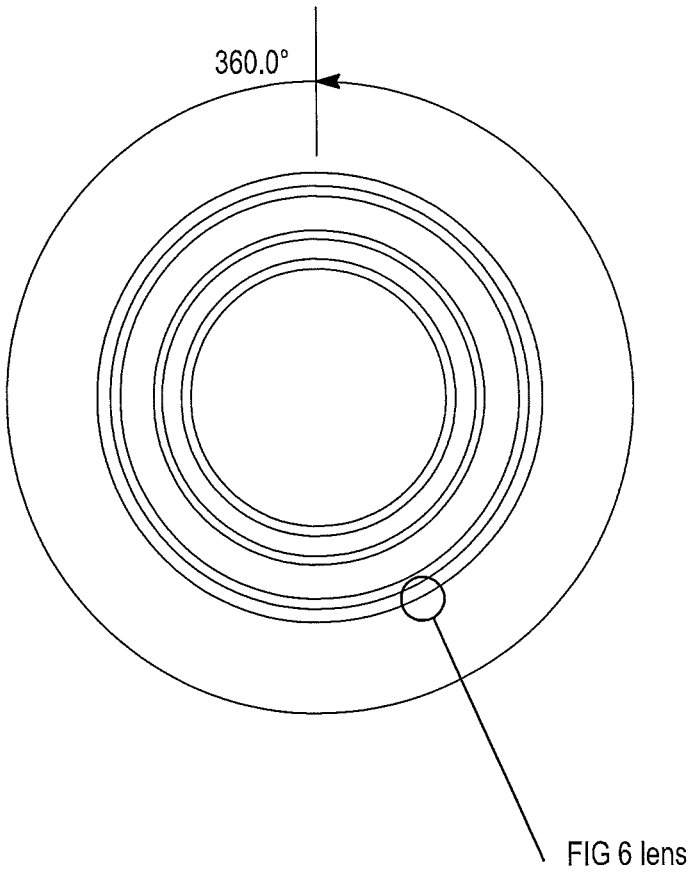
FIG. 7C is a top planar view of the lens of FIGS. 6A, 6B.

FIGS. 7A, 7B respectively illustrate the alpha plane and the beta plane relative to the lens 30. FIG. 7C illustrates the beta plane for the lens 50.

Figure 8A:
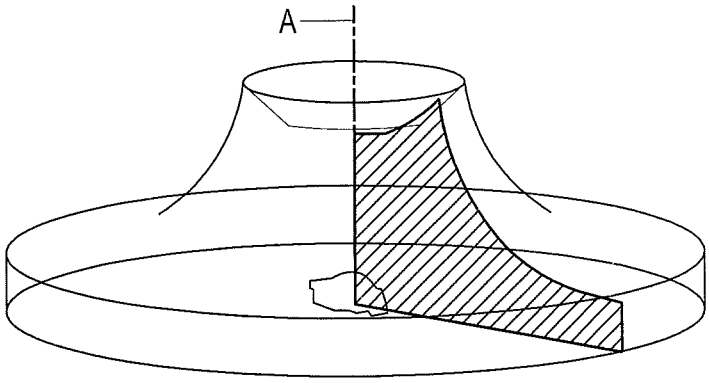
FIG. 8A illustrates an exemplary 360 degree light output profile from an output device as in FIG. 1.
Figure 8B:
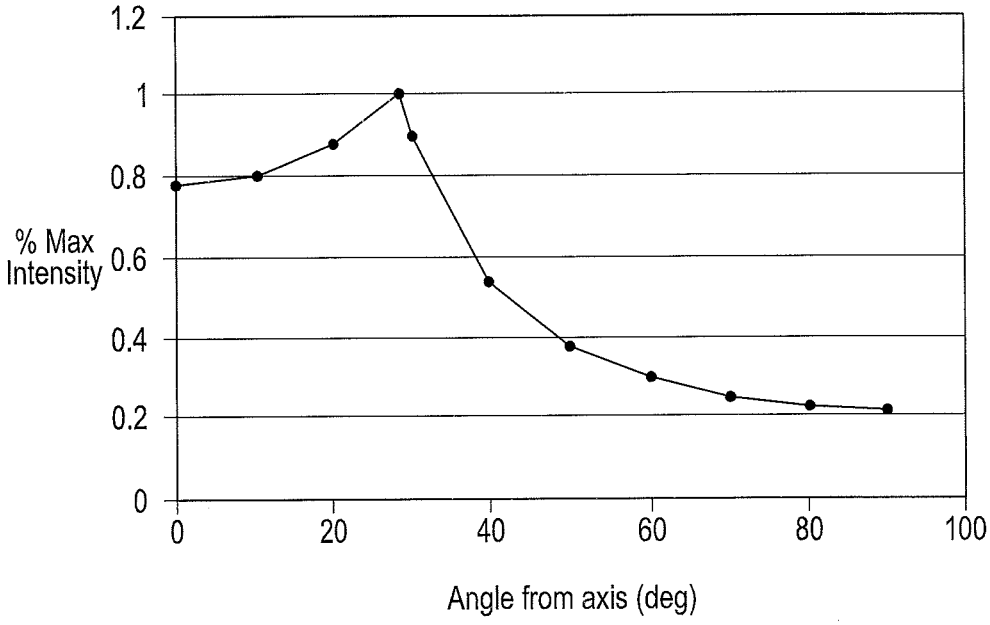
FIG. 8B illustrates an exemplary 90 degree light output profile.

FIG. 8A illustrates an intensity profile of visible light output from a device 20, as in FIG. 1. The light is emitted for the full three hundred sixty degrees of revolution about the device axis A which produces the desired radiant distribution. FIG. 8B illustrates an exemplary ninety degree output profile extending from the axis of symmetry A.

In summary, in accordance with embodiments hereof, a circular LED array is positioned at a predetermined distance from and generally parallel to an optical Fresnel lens. This configuration overcomes the need to specify the rotational position of the product on a mounting surface. Once the correct installation height is achieved it is not necessary to align any light output elements (in this case LED's) to any given instance relative to the horizontal floor.

The combination of the light emitting diodes, arranged in a circle with a selected diameter, a Fresnel ring array of the polycarbonate lens and the predetermined distance of the emission surfaces of the light emitting diodes to each of the Fresnel rings allows light propagated from those diodes to be refracted in a proportional manner from the diode array to a diverse spectrum of viewing angles relative to the device when installed. This is achieved in the main by the incident angles of each of the Fresnel ring faces and the intrinsic relationship of each ring to its neighbor and the family of rings as a whole.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

Further, logic flows depicted in the figures do not require the particular order shown, or sequential order, to achieve desirable results. Other steps may be provided, or steps may be eliminated, from the described flows, and other components may be add to, or removed from the described embodiments.

The invention claimed is:

1. A visual output device comprising:

a Fresnel type lens sisposed symmetrical about a central axis, wherein the Fresnel type lens has a partly bounded interior region; and a plurality of light sources symmetrically and circularly distributed about the central axis in the partly bounded interior region, wherein the plurality of light sources are disposed on a plane that is substantially parallel with the Fresnel type lens, wherein the central axis is substantially perpendicular to the plane, wherein the plurality of light sources are located a predetermined distance from the lens, and, wherein the plurality of light sources are configured to simultaneously emit respective light pulses directly toward the lens when energized, which upon passing through the Fresnel type lens provide a predetermined, omni-directional, light output pattern, relative to the central axis.

2. The output device as in claim 1, further comprising: drive circuitry, disposed adjacent to the light sources, wherein the drive circuitry is configured to simultaneously energize the sources and thereby emit the respective light pulses.

3. The output device as in claim 1, wherein the plurality of light sources comprise a plurality of light emitting diodes disposed about the central axis.

4. The output device as in claim 3, further comprising: a planar mounting member that at least substantially closes the partly bounded interior region, wherein the planar mounting member carries the plurality of light emitting diodes.

5. The output device as in claim 4, further comprising a pulsed current power supply, wherein the pulsed current power supply is configured to simultaneously energize all of the plurality of light emitting diodes for a predetermined time interval.

6. The output device as in claim 5, wherein the plurality of light emitting diodes are displaced a predetermined distance from an exterior surface of the lens.

7. The output device as in claim 6, wherein the predetermined distance is approximately 18 mm.

8. The output device as in claim 6, wherein the plurality of light emitting diodes are arranged with a circular diameter of approximately 30 mm.

9. The output device as in claim 6, further comprising a mounting base that carries at least the Fresnel type lens and the plurality of light emitting diodes.

10. A visual alarm indicating output device comprising:

a plurality of light sources symmetrically arranged in a circular pattern about a centerline, wherein each of the plurality of light sources is oriented so that respective light output is emitted directly toward a common, cylindrical Fresnel lens, wherein the plurality of light sources are coplanar, wherein a plane of the plurality of light sources is substantially perpendicular to the centerline, and wherein the lens is symmetrical about the centerline; and a common current supply, wherein the common current supply is configured to pulse the plurality of light sources.

11. The output device as in claim 10, further comprising a planar support member attached to the Fresnel lens, wherein the plurality of light sources are disposed on the planar support member and extend therefrom toward the lens.

12. The output device as in claim 11, further oomprising: control and light drive circuits, wherein the control and light drive circuits are carried by the planar member and are coupled to the light sources.

13. The output device as in claim 12, wherein the plurality of light source and the Fresnel lens combination are configured to emit output light that exhibits a radiant distribution, about the centerline, which exceeds a predetermined parameter.

14. A method comprising:

energizing a plurality of sources of visible light, wherein the plurality of sources of visible light are arranged in a plane, wherein the plurality of sources of visible light are arranged symmetrically and circularly about a center line, wherein a selectively shaped Fresnel lens is disposed symmetrically about the center line at a distance from the plurality of sources of visible light; and emitting visible light from the plurality of sources of visible light directly toward the Fresnel lens;

generating a uniform output intensity profile of the visible light around the center line that exceeds a predetermined intensity profile.

15. The method as in claim 14, further comprising: mounting the plurality of sources of visible light and the Fresnel lens without specifying a rotational position thereof.

16. The method as in claim 15, further comprising: energizing the plurality of sources of visible light from a displaced energy supply.

17. The method as in claim 16, wherein energizing the plurality of sources of visible light comprises energizing the plurality of sources of visible light with a plurality of spaced apart electrical pulses.

18. The method as in claim 16, wherein the Fresnel lens refracts light from the plurality of sources of visible light in a proportional manner about the center line.

19. The method as in claim 18, wherein energizing the plurality of sources of visible light comprises controlling the energizing of the plurality of sources of visible light with a displaced control unit.

20. The method as in claim 18, further comprising coupling the lens to a mounting element for the plurality of sources of visible light using snap fit features.

* * * * *